US005411075A

United States Patent [19]

Pien et al.

[11] Patent Number: 5,411,075

[45] Date of Patent: May 2, 1995

[54] ROLL FOR USE IN CASTING METAL PRODUCTS AND AN ASSOCIATED METHOD

[75] Inventors: S. John Pien, Export; Albert C. Wang; Ronald Bachowski, both of Murrysville, all of Pa.

[73] Assignee: Aluminum Company of America, Pittsburgh, Pa.

[21] Appl. No.: 114,782

[22] Filed: Aug. 31, 1993

[51] Int. Cl.[6] ..... B22D 11/128

[52] U.S. Cl. ..... 164/485; 164/443; 164/463; 164/480

[58] Field of Search ..... 164/443, 423, 463, 479, 164/480, 485, 427, 428

[56] References Cited

U.S. PATENT DOCUMENTS

| | | | |
|---|---|---|---|
| 2,108,071 | 2/1938 | Low . | |
| 2,108,752 | 2/1938 | Low . | |
| 3,183,563 | 5/1965 | Smith, Jr. . | |
| 4,033,406 | 7/1977 | Basiulis . | |
| 4,307,771 | 12/1981 | Draizen et al. . | |
| 4,342,621 | 8/1982 | Keating, Jr. . | |
| 4,489,772 | 12/1984 | McLane et al. | 164/429 |
| 4,489,773 | 12/1984 | Miller . | |
| 4,502,528 | 3/1985 | Frissora et al. . | |
| 4,537,239 | 8/1985 | Badzyn et al. . | |
| 4,671,340 | 6/1987 | Larrecq et al. | 164/429 |
| 4,721,154 | 1/1988 | Christ et al. . | |
| 4,749,023 | 6/1988 | Draper et al. | 164/443 |
| 4,794,977 | 1/1989 | Iversen . | |
| 4,799,536 | 1/1989 | Ingalls et al. | 164/443 |
| 4,842,040 | 6/1989 | Bibler et al. . | |
| 5,191,925 | 3/1993 | Sosin | 164/429 |
| 5,228,497 | 7/1993 | Romanowski | 164/443 |

FOREIGN PATENT DOCUMENTS

| | | | |
|---|---|---|---|
| 0110653 | 6/1984 | European Pat. Off. | 164/429 |
| 57-187147 | 11/1982 | Japan | 164/423 |
| 57-190754 | 11/1982 | Japan | 164/423 |
| 59-30455 | 2/1984 | Japan | 164/423 |
| 1245947 | 10/1989 | Japan | 164/423 |
| 3210944 | 9/1991 | Japan | 164/429 |
| 1488115 | 6/1989 | U.S.S.R. . | |

OTHER PUBLICATIONS

P. D. Dunn et al., "The Heat Pipe", *Physics in Technology*, vol. 4, No. 3, (1973), pp. 187–201.

S. N. Ojha et al., "Microstructure and Mechanical Properties Of Al-$CuAl_2$ Eutectic Alloys Solidified Over A Heat Pipe", *Journal Of Material Sciences*, vol. 18, No. 4, (Apr. 1983), pp. 1174–1182.

*Primary Examiner*—P. Austin Bradley
*Assistant Examiner*—James Miner
*Attorney, Agent, or Firm*—David V. Radack

[57] ABSTRACT

A roll for use in a roll caster. The roll has a heat exchanger core and an outer generally cylindrical shell surrounding the core, the core and the shell defining an enclosed space. A working fluid is contained in the enclosed space. When molten metal is cast onto the shell, the working fluid in proximity to the outer shell changes from a liquid to a vapor. Due to the rotation of the roll, the liquid phase of the working fluid forces the vapor in proximity with the outer cylindrical shell to return to the area adjacent to the core. At this area, the vapor phase is condensed into a liquid which is then subsequently delivered radially to the outer cylindrical shell. In this way, the working fluid constantly changes from vapor to liquid and back to vapor again and acts to continuously remove heat from the molten metal cast onto the outer cylindrical shell. A single roll caster, a twin roll caster, and a melt spinning apparatus as well as an associated method are also disclosed.

29 Claims, 3 Drawing Sheets

ROLL FOR USE IN CASTING METAL PRODUCTS AND AN ASSOCIATED METHOD

BACKGROUND OF THE INVENTION

This invention relates to a roll for use in casting metal products and an associated method, and more specifically to a roll defining an enclosed space which contains a working fluid which is converted from liquid to vapor phase and back again respectively to remove heat from the roll outer surface.

Roll casting, such as single roll casting, twin roll casting or melt spinning for example, is a well known method of producing metal products such as metal foil and strip. Roll casting is used to cast steel, aluminum, copper and other metals.

In most roll casting operations, molten metal is introduced onto the surface of the rotating roll. The rotating roll removes heat from the molten metal, causing the molten metal to solidify into a cast metal product such as foil or strip. There are numerous examples of roll casting machines in the prior art, such as those disclosed in U.S. Pat. Nos. 4,489,773; 4,502,528; 4,794,977 and 4,842,040.

In all of the above-cited patents, and in roll casting in general, heat is removed by providing a coolant that circulates in the hollow roll. For example, U.S. Pat. No. 4,794,977 teaches that the coolant is supplied to the core of the roll from an outside source and is guided to the outer surface by guide means. After performing its transfer function at the inner surface of the outer shell, the coolant is directed into the core and is exhausted therefrom.

There are several limitations inherent in these so-called "open systems". First, a strict design for sealing and mechanical couplings is required for safety and maintenance reasons. Second, the coolant, because it does not change phase from liquid to vapor, must be kept at a low temperature in order to perform its heat exchanging role. This, however, causes a large thermal gradient (metal to coolant) through the roll which induces thermal stresses that accelerate roll damage and shorten roll life. Third, because the heat extraction rate is limited, thinner roll walls are used which weaken the strength of the roll and which may result in roll deformation. Finally, it is difficult to maintain uniform circumferential temperature near the roll surface.

Thus, what is needed is a roll design that avoids the limitations of the prior art but which provides excellent heat extraction to produce quality cast metal products.

SUMMARY OF THE INVENTION

The roll of the invention has met the above need. The roll comprises a heat exchanger core and an outer generally cylindrical shell surrounding the core, the core and the shell defining an enclosed space. A working fluid is contained in the enclosed space. When molten metal is cast onto the shell, the working fluid in proximity to the outer shell changes from a liquid to a vapor. Due to the rotation of the roll, the liquid phase of the working fluid forces the vapor in proximity with the outer cylindrical shell to return to the area adjacent to the core. At this area, the vapor is condensed into a liquid which is then subsequently delivered radially to the outer cylindrical shell. In this way, the working fluid constantly changes from vapor to liquid and back to vapor again and acts to continuously remove heat from the molten metal cast onto the outer cylindrical shell.

A single roll caster, a twin roll caster, and a melt spinning apparatus are also disclosed using the roll of the invention.

The method of the invention comprises providing a supply of molten metal and introducing the molten metal onto the surface of a rotatable roll as set forth above.

It is an object of the invention to provide a "closed system"in which a working fluid is enclosed in the space defined by the outer cylindrical shell and the inner core.

It is a further object of the invention to use a working fluid which changes to the vapor phase when near the outer cylindrical shell and which changes back to the liquid phase when in proximity with the core.

It is still a further object of the invention to provide heat exchanger means in the core to enhance the phase change in the working fluid from vapor to liquid.

It is yet another object of the invention to provide a thicker roll wall thickness so as to minimize thermal stresses and increase the working life of the roll.

It is another object of the invention to reduce the thermal gradient in the outer cylindrical shell thus prolonging roll life.

It is a further object of the invention to provide a roll that is easy to manufacture and safe to operate and maintain.

These and other objects of the invention will become more readily apparent as the following detailed description of the preferred embodiments proceeds.

DETAILED DESCRIPTION

As used herein, whenever the name of a metal is used, such as steel, aluminum or copper, that name is deemed to include alloys of that particular metal. Also as used herein the term "metal products"means castings made of metal.

Figure 1:
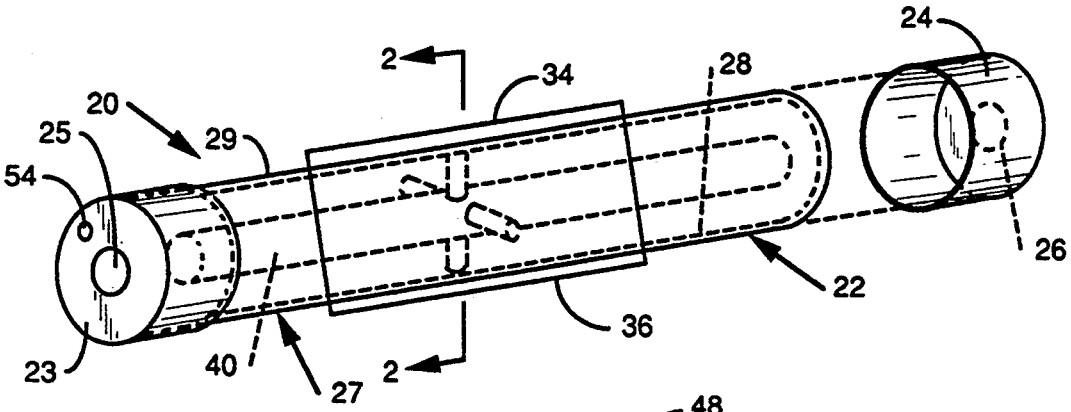
FIG. 1 is a partially exploded perspective view showing the roll of the invention.

Referring now to FIG. 1, a roll 20 for use in casting metal products in accordance with the invention is shown. The roll 20 is generally cylindrical and is made of a suitable material, such as steel. The roll 20 includes an outer cylindrical shell 22 consisting of a pair of flanges 23, 24 which form end walls and which define openings 25, 26 and a central cylindrical shell portion 27. The central cylindrical shell portion 27 consists of an inner cylindrical surface 28 and an outer cylindrical surface 29.

A sleeve member 34 made of copper, preferably, is disposed on a portion of the outer cylindrical surface 29 of the central cylindrical shell portion 27. As is known to those skilled in the art, the copper sleeve member 34 is shrink-fit onto the central cylindrical shell portion 27. This involves heating the sleeve so that it will expand, and when expanded, slipping the central cylindrical shell into the sleeve 34. When the sleeve 34 cools it will contract and intimately engage the shell 27. It is well known that the copper sleeve member 34 is employed in lieu of casting molten metal directly onto a roll surface, in that the copper sleeve member 34 only, and not the entire roll, can be replaced after prolonged casting of the molten metal. It will be appreciated, however, that the invention herein also contemplates casting the molten metal directly onto the central cylindrical shell portion 27 without the need for the sleeve 34, however, this is less preferred.

Figure 2:
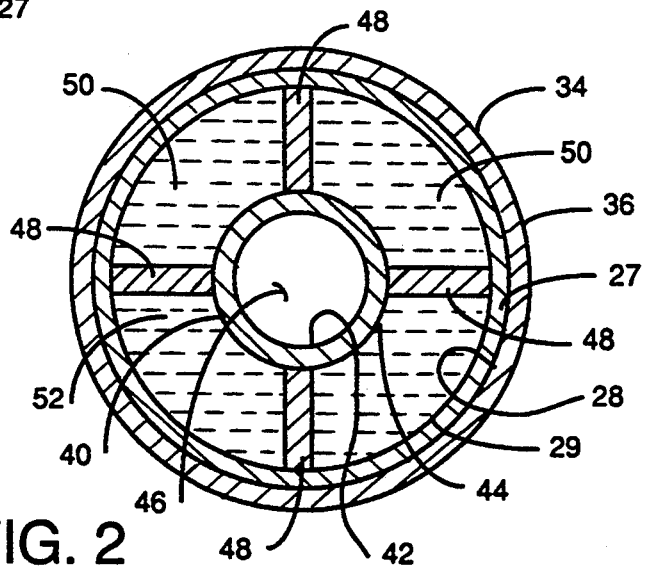
FIG. 2 is a cross-sectional view taken along line 2—2 of FIG. 1.

Disposed inside and surrounded by the central cylindrical shell portion 27 is a cylindrical core member 40 which is shown in phantom line drawing in FIG. 1 and in cross-section in FIG. 2. The core member 40 has an inner cylindrical surface 42 and an outer cylindrical surface 44 and defines a passageway 46. The core member 40 has a longitudinal axis that is generally the same as the longitudinal axis of the central cylindrical shell portion 27. The core member 40 is supported inside the central cylindrical shell portion 27 by the end walls 23, 24 and, optionally, by a series of ribs 48, four of which are shown in FIG. 2.

The ribs 48 can be secured to the core member 40 as by welding or the ribs 48 may be formed integrally with the core member 40. The number of ribs 48, their arrangement and the size of the ribs 48 will vary according to the size of the roll 20, but it is desired to keep the number at a minimum and in fact, to not use ribs 48 at all. Most of the support for the core member 40 is provided by the end walls 23, 24. It will be appreciated that the core member 40 protrudes beyond the end walls 23, 24 thus providing extra support for the core member 40.

Referring to FIG. 2, it can be seen that the outer cylindrical shell 22 and the core member 40 define a completely enclosed space 50. Disposed in this enclosed space 50 is a working fluid 52. This working fluid 52 is chosen so that its boiling point is approximately equal to the temperature at the inner cylindrical surface 28 when molten metal is cast onto the roll 20. This is because, as will be explained below, the working fluid 52 undergoes a phase change from liquid to vapor when it is adjacent to the outer cylindrical surface. Furthermore, the working fluid 52 preferably has a melting point below room temperature (i.e., 20° C.), because it is desired to keep the working fluid 52 in a liquid phase when the roll is not being used. A working fluid 52 that is contemplated by the invention is water.

The amount of working fluid 52 is chosen such that the enclosed space 50 is not too solidly packed with working fluid 52 so the working fluid 52 is unable to change from a liquid to vapor phase, however, on the other extreme, the amount of working fluid must be adequate to cause effective heat transfer in the roll.

The roll 20 is constructed in the following manner. The central cylindrical shell portion 27 is first provided, and the end walls 23, 24 are kept off to the side. The core member 40, having ribs 48 are placed into position inside the outer cylindrical shell 27 and can be fastened by screws (not shown) which are placed in the shell 27 and through the rib 48. The flanges 23 and 24 are then secured to the outer cylindrical shell 27. The working fluid 52 is introduced into the enclosed space 50 through a port 54 disposed on flange 23 (See FIG. 1).

Figure 3:
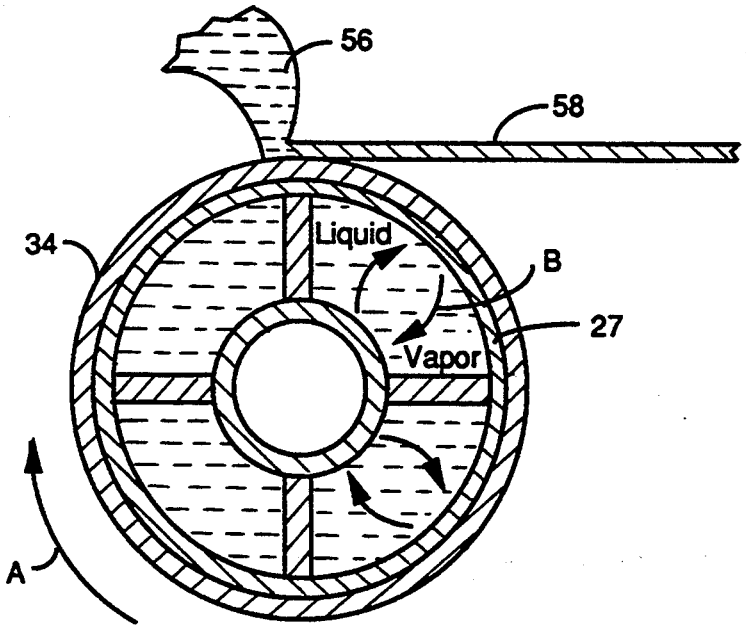
FIG. 3 is a view similar to FIG. 2 only showing the action of the working fluid when molten metal is introduced onto the rotating roll.

FIG. 3 is a partially schematic diagram which shows the operation of the roll 20 when metal is cast thereon.

The roll 20 is rotatably mounted and is driven by drive means (not shown) in the direction of arrow A. Molten metal 56 from a molten metal source (not shown), is introduced onto the copper sleeve 34 of the roll 20. Due to the properties of the working fluid 52, once the molten metal 56 is introduced onto the copper sleeve 34, the working fluid 52 will take heat away from the molten metal 56 through the surface of the sleeve 34 and the shell 27.

The solidifying molten metal 58 releases heat and this heat causes the working fluid 52 in the enclosed space 50 of the roll 20 to change from a liquid to a vapor, due to the above mentioned properties of the working fluid. Once the working fluid 52 changes to vapor, the rotation of the roll 22 causes the vapor phase to move towards the central core member 40. This movement will also be facilitated by the force of the liquid being delivered radially, due to centrifugal force, towards the outer cylindrical shell, as is shown by the arrow B in FIG. 3. Once the vapor is in proximity with the central core member 40, it is condensed into a liquid, because, as will be shown in FIG. 4, the central core member 40 is a heat exchanger which takes heat away from the working fluid vapor. As will be appreciated, this process of continuous phase changes from liquid to vapor and back to liquid continues as long as the roll 20 is rotating and as long as the core member 40 acts as a heat exchanger.

The rotational speed of the roll 20 is related to the efficiency of the heat removal process. The greater the rotational speed (measured in rpm's) the higher the H value (H being defined as BTU/hr-ft$^2$) and the more efficient the process. Higher rotational speeds also translate into greater peripheral speed of the metal product that comes off of the roll. The roll can be rotated at speeds from 0.5 rpm to 300 rpm. The wall thickness of the cylindrical shell of the invention can be greater than the thickness of prior art rolls because of the enhanced thermal transfer of the roll of the invention. This results in longer roll life. Also, because of the increased efficiency of the thermal transfer of the roll of the invention, thermal gradients in the roll are reduced thus reducing thermal stresses in the roll. This, too, will prolong roll life.

Figure 4:
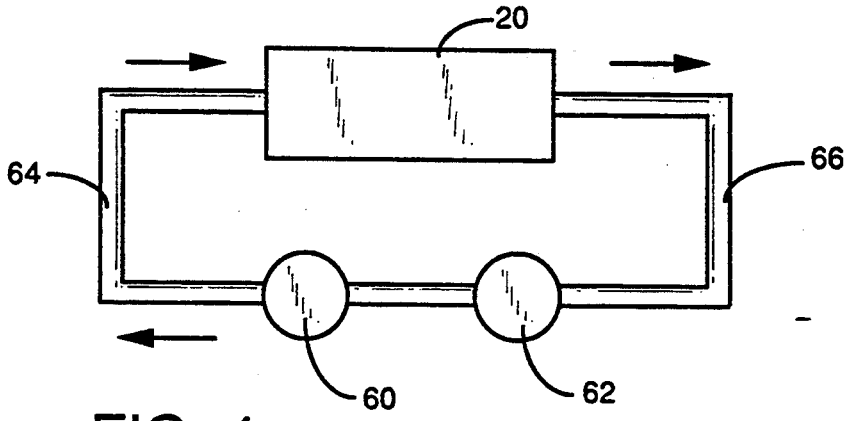
FIG. 4 is a schematic view showing the coolant pumping system.

Referring now to FIG. 4, the heat exchanging core member 40 will be discussed in detail. As was described in FIG. 2 above, the core member 40 defines a passageway 46. In one embodiment, the heat exchange mechanism simply is to introduce a coolant, such as water, for example, into the passageway 46. This is accomplished by the system shown in FIG. 4 which includes a pump 60, a heat exchanger 62 to cool the heated water and inlet tubing 64 to introduce the cooled water into the passageway and outlet tubing 66 to take the heated water away from the core member 40 and deliver it back to the heat exchanger 62 and pump 60.

Figure 5:
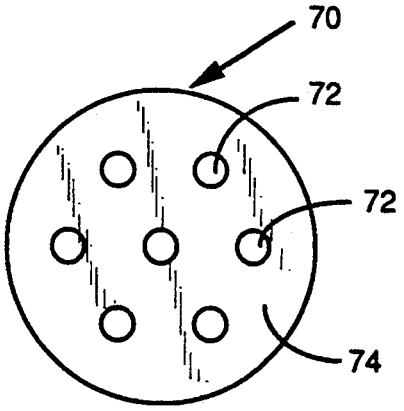
FIG. 5 is a vertical section of one embodiment of a heat exchanger means.
Figure 6:
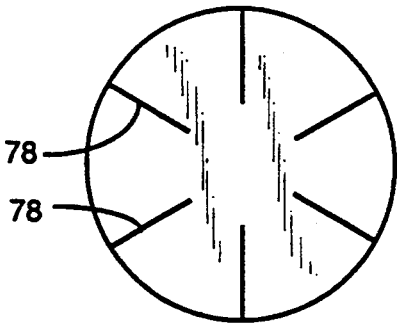
FIG. 6 is a vertical section of another embodiment of a heat exchanger means.

Other embodiments of the heat exchanging core member are shown in FIGS. 5 and 6. FIG. 5 shows a heat exchanging means 70 which consists of a series of tubes 72 that are disposed along the core members longitudinal axis. The tubes 72 are held in place by a plurality of spacer plates, one of which, spacer plate 74, is shown in FIG. 5. A coolant, such as water, is introduced into the tubes 72 by a closed system similar to that shown in FIG. 4. FIG. 6 shows another embodiment whereby longitudinal aluminum fins 78 can be used to enhance the heat exchange in the core member 40.

Figure 7:
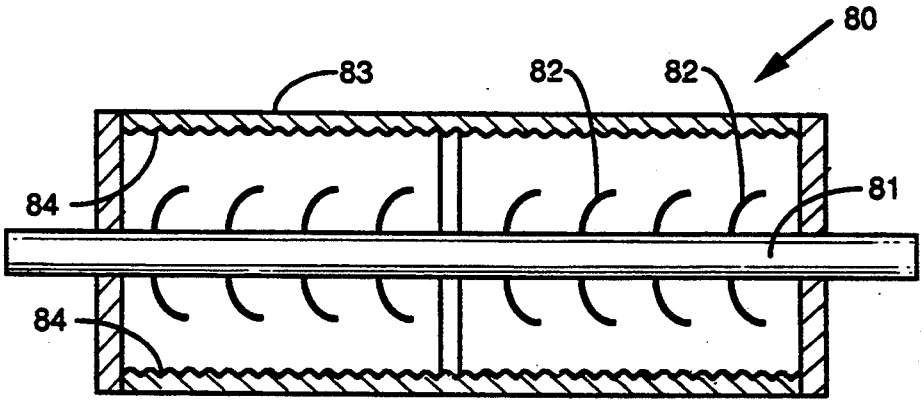
FIG. 7 is a longitudinal section of the roll showing enhancements to the core and the roughening of the inner surface of the shell.

FIG. 7 illustrates another embodiment of the roll. This roll 80 has a core member 81 which includes arcuate vanes 82 which will act to enhance the radial "throwing"of the working fluid to the outer cylindrical shell 83 described above. This roll 80 also shows a roughened inner surface 84 for the central cylindrical shell member 83. The roughened inner surface 84 also improves heat transfer from the outer surface of the cylindrical shell 83 to the inner surface thereof. Instead of roughening or even in addition to roughening, the inner surface of the shell can also have fins or vanes (not shown) which also enhance heat transfer.

Figure 8:
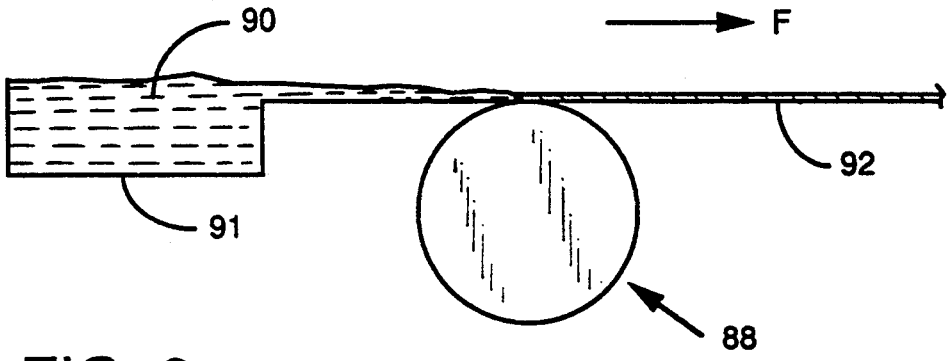
FIG. 8 is an elevational view of a single roll caster using the roll of the invention.

It will be appreciated by those skilled in the art that a roll made in accordance with the invention can be used in single roll casting processes as well as twin roll casting processes. Referring to FIG. 8, a single roll casting process is shown using a roll 88 made in accordance with the invention. As is known to those skilled in the art, molten metal 90 from a tundish 91 overflows the tundish 91 and is introduced onto the rotating roll 20. The molten metal 90 is solidified as it contacts the roll 20 and the solidified metal product 92 moves off of the roll 20 in the direction of arrow F. The sheet 92 can then be coiled (not shown).

Figure 9:
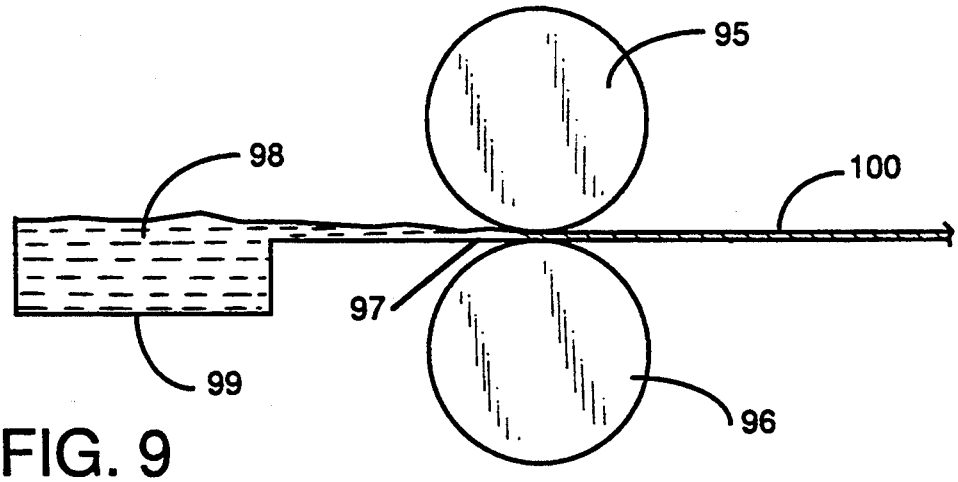
FIG. 9 is an elevational view of a twin roll caster using two rolls of the invention.

FIG. 9 shows a twin roll casting process wherein an upper roll 95 and a lower roll 96 form a casting mold 97. One or both of the rolls 95 and 96 can be made in accordance with the invention. Molten metal 98 from a tundish 99 is introduced into the casting mold 97 and is solidified therein and a cast metal product 100 is produced. Although a horizontal casting arrangement is shown, it will be appreciated that the rolls of the invention are suitable for vertical twin roll casting processes or casting machines which are angularly disposed.

Figure 10:
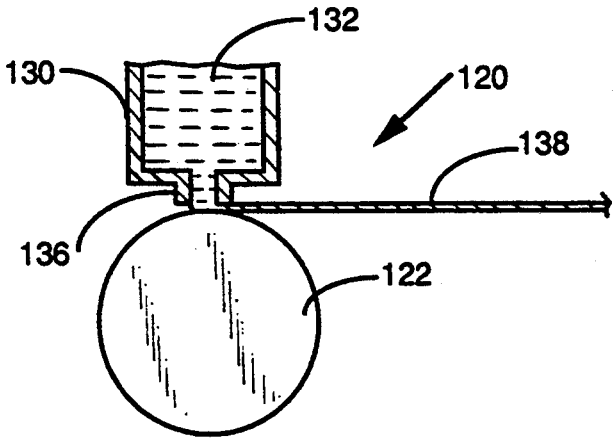
FIG. 10 is an elevational view of a melt spinning apparatus using the roll of the invention.

FIG. 10 shows a melt spinning apparatus 120 which includes a roll 122 made in accordance with the invention. As is known to those skilled in the art, the melt spinning apparatus 120 consists of a tundish 130 which holds molten metal 132, the molten metal 132 being delivered to the roll 122 by a nozzle 136. The molten metal 132 solidifies upon contact with the roll 122 and a cast metal product 138 is produced.

It will be appreciated that the rolls can be used for casting several types of molten metal including but not limited to steel and aluminum. Aluminum alloys such as Aluminum Association designations 1100, 1145, 3003, 5052, 7072 and 8XXX can be cast into aluminum foils and sheet having thicknesses from about 1 to 10 mm.

It will be appreciated that a roll for use in casting molten metal has been disclosed that can be used in single or twin roll casting processes. The roll effectively and efficiently removes heat from the solidifying molten metal while avoiding the several limitations of prior art rolls and processes set forth in the Background section above.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A roll for use in casting metal products from molten metal comprising:

a heat exchanger core including an inlet portion and an outlet portion for receiving and discharging a coolant fluid from a coolant fluid source;

an outer generally cylindrical shell surrounding said heat exchanger core, said outer cylindrical shell and said heat exchanger core defining an enclosed space; and a working fluid contained in said enclosed space, said heat exchanger core separating said working fluid from said coolant fluid so that said coolant fluid does not enter into said enclosed space, whereby when molten metal is cast onto said outer cylindrical shell, said working fluid in proximity with said outer cylindrical shell changes from a liquid to a vapor and due to the rotation of said roll, the liquid phase of the working fluid forces said vapor in proximity with said outer cylindrical shell to return to an area adjacent said core where said vapor is condensed into a liquid which is then subsequently delivered radially to said outer cylindrical shell.

2. The roll of claim 1, wherein said heat exchanger core is generally cylindrical and contains heat exchanging means for at least partially directing the flow of said coolant fluid through said core.

3. The roll of claim 2, wherein said heat exchanging means includes a plurality of longitudinal fins.

4. The roll of claim 2, wherein said heat exchange means includes a plurality of tubes in which said coolant fluid can flow.

5. The roll of claim 1, wherein said working fluid has a boiling temperature approximately equal to the operational temperature of the outer cylindrical shell.

6. The roll of claim 5, wherein said working fluid has a melting point below about 20° C.

7. The roll of claim 1, including a plurality of ribs secured to said heat exchanger core and attached to said outer cylindrical shell to provide additional structural support to said heat exchanger core.

8. The roll of claim 1, wherein said outer cylindrical shell includes a cylindrical portion and a pair of end walls each of which define an opening within which said heat exchanger core is disposed, said end walls being attached to each end of said cylindrical portion.

9. The roll of claim 1, including an outer sleeve in contacting circumferentially surrounding relationship with respect to the outer surface of said outer cylindrical shell.

10. The roll of claim 9, wherein said outer sleeve is made of a material comprising copper.

11. The roll of claim 1, including means disposed on the outer surface of said heat exchanger core for enhancing radial delivery of said working fluid to said outer cylindrical shell.

12. The roll of claim 1, wherein said internal surface of said outer cylindrical shell is roughened to enhance heat transfer.

13. A roll for use in casting metal products from molten metal comprising:

a heat exchanger core;

an outer generally cylindrical shell surrounding said heat exchanger core, said outer cylindrical shell and said heat exchanger core defining an enclosed space;

a working fluid contained in said enclosed space, whereby when molten metal is cast onto said outer cylindrical shell, said working fluid in proximity with said outer cylindrical shell changes from a liquid to a vapor and due to the rotation of said roll, the liquid phase of the working fluid forces said vapor in proximity with said outer cylindrical shell to return to an area adjacent said core where said vapor is condensed into a liquid which is then subsequently delivered radially to said outer cylindrical shell;

means disposed on the outer surface of said heat exchanger core for enhancing radial delivery of said working fluid to said outer cylindrical shell; and said means disposed on the outer surface of said heat exchanger core includes a plurality of guiding vanes each having one end attached to said heat exchanger core and extending in an arcuate path therefrom.

14. A single roll caster comprising:

molten metal supply means;

a rotatable roll on which molten metal from said molten metal supply means is cast, said rotatable roll comprising:

a heat exchanger core including an inlet portion and an outlet portion for receiving and discharging a coolant fluid from a coolant fluid source;

an outer generally cylindrical shell surrounding said heat exchanger core, said outer cylindrical shell and said heat exchanger core defining an enclosed space; and a working fluid contained in said enclosed space, said heat exchanger core separating said working fluid from said coolant fluid so that said coolant fluid does not enter into said enclosed space; and means for driving said rotatable roll.

15. The single roll caster of claim 14, wherein said single roll caster is a melt spinning apparatus.

16. The single roll caster of claim 14, wherein said outer cylindrical shell includes a cylindrical portion and a pair of end walls which each define opening within which said heat exchanger core is disposed, an said end walls being attached to each end of said cylindrical portion.

17. The single roll caster of claim 14, including an outer sleeve in contacting circumferentially surrounding relationship with respect to the outer surface of said outer cylindrical shell.

18. A twin roll caster comprising:

molten metal supply means;

a pair of rotatable rolls defining a mold for receiving molten metal from molten metal supply means, at least one of said rolls comprising:

a heat exchanger core including an inlet portion and an outlet portion for receiving and discharging a coolant fluid from a coolant fluid source;

an outer generally cylindrical shell surrounding said heat exchanger core, said outer cylindrical shell and said heat exchanger core defining an enclosed space; and a working fluid contained in said enclosed space, said heat exchanger core separating said working fluid from said coolant fluid so that said coolant fluid does not enter into said enclosed space; and means for driving said rotatable roll.

19. The twin roll caster of claim 18, wherein said outer cylindrical shell includes a cylindrical portion and a pair of end walls which each define an opening within which said heat exchanger core is disposed, said end walls being attached to each end of said cylindrical portion.

20. The twin roll caster of claim 18, including an outer sleeve in contacting circumferentially surrounding relationship with respect to the outer surface of said outer cylindrical shell.

21. A method of casting a metal product comprising:

providing casting apparatus including a rotatable roll to cast metal product from molten metal, said roll including (i) a heat exchanger core including an inlet portion and an outlet portion for receiving and discharging a coolant fluid from a coolant fluid source; (ii) an outer generally cylindrical shell surrounding said core, said shell and said core defining an enclosed space; and (iii) a working fluid contained in said enclosed space, said heat exchanger core separating said working fluid from said coolant fluid so that said coolant fluid does not enter into said enclosed space;

delivering molten metal from a molten supply means to said casting apparatus; and simultaneously with casting said molten metal, causing said working fluid in proximity with said shell to change from a liquid to a vapor and returning said vapor to said core where said vapor is changed back into a liquid to be delivered radially to said shell by the rotation of said roll and by the force of the vapor phase of the working liquid being pushed back inwardly to said core.

22. The method of claim 21, including said molten metal is steel.

23. The method of claim 22, including said molten metal is aluminum.

24. The method of claim 23, including said aluminum is an aluminum alloy selected from the group consisting of Aluminum Association alloy designations 1100, 1145, 3003, 5052, 7072 and 8XXX.

25. The method of claim 22, including employing as said casting apparatus a single roll caster.

26. The method of claim 22, including employing as said casting apparatus a twin roll caster.

27. The method of claim 22, including employing as said casting apparatus a melt spinning apparatus.

28. The method of claim 21, including rotating said rotatable roll at a speed of from about 0.5 rpm to 300 rpm.

29. The method of claim 21, including said metal product has a thickness from about 1 to 10 mm.

* * * * *